US010219078B2

(12) United States Patent
Zhang et al.

(10) Patent No.: US 10,219,078 B2
(45) Date of Patent: Feb. 26, 2019

(54) LOUDSPEAKER MODULE

(71) Applicant: Goertek Inc., Weifang (CN)

(72) Inventors: Jun Zhang, Weifang (CN); Chengfei Zhang, Weifang (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 15/792,642

(22) Filed: Oct. 24, 2017

(65) Prior Publication Data

US 2018/0048964 A1 Feb. 15, 2018

Related U.S. Application Data

(63) Continuation of application No. 15/507,997, filed as application No. PCT/CN2015/082939 on Jun. 30, 2015, now Pat. No. 10,021,489.

(30) Foreign Application Priority Data

Sep. 1, 2014 (CN) ..... 2014 1 0440173

(51) Int. Cl.
*H04R 9/06* (2006.01)
*H04R 1/02* (2006.01)
*H04R 9/02* (2006.01)

(52) U.S. Cl.
CPC ..... *H04R 9/06* (2013.01); *H04R 1/02* (2013.01); *H04R 1/025* (2013.01); *H04R 9/025* (2013.01)

(58) Field of Classification Search
CPC ..... H04R 9/06; H04R 9/025; H04R 1/025; H04R 1/021; H04R 2201/02;
(Continued)

(56) References Cited

U.S. PATENT DOCUMENTS 7,630,491 B1 * 12/2009 Uyehara ..... H04M 1/035 379/433.01
8,238,595 B2 8/2012 Horowitz et al.
(Continued)

FOREIGN PATENT DOCUMENTS

CN 202424972 U 9/2012
CN 202425032 U 9/2012
(Continued)

OTHER PUBLICATIONS

USPTO, Notice of Allowance and Fee(s) Due for U.S. Appl. No. 15/507,997 dated Mar. 14, 2018.

*Primary Examiner* — Jason R Kurr
(74) *Attorney, Agent, or Firm* — LKGlobal|Lorenz & Kopf, LLP

(57) ABSTRACT

A loudspeaker module includes, but is not limited to, an independent housing enclosing a sealed cavity. The independent housing is provided with an opening communicating the cavity with the exterior. The loudspeaker module further includes, but is not limited to, a loudspeaker unit including, but not limited to, a vibration system, a magnetic circuit system and a casing and a front cover that receive the vibration system and the magnetic circuit system, a sidewall of the casing is provided with a rear sound aperture. An acoustic wave above the vibration system directly radiates to the exterior, and an acoustic wave below the vibration system radiates to a side via the rear sound aperture. The loudspeaker unit and the independent housing combine so that the rear sound aperture and the opening are sealingly engaged and communicate. The cavity of the independent housing forms a rear acoustic cavity of the loudspeaker module.

14 Claims, 3 Drawing Sheets

(58) Field of Classification Search
CPC .... H04R 2499/11; H04R 1/28; H04R 1/2803; H04R 1/2807; H04R 1/2811; H04R 1/2815; H04R 1/2819; H04R 1/2853; H04R 1/2857
See application file for complete search history.

(56) References Cited

U.S. PATENT DOCUMENTS

| | | | | |
|---|---|---|---|---|
| 2008/0219490 | A1 | 9/2008 | Yang et al. | |
| 2013/0223655 | A1 | 8/2013 | Lee et al. | |
| 2014/0294225 | A1 | 10/2014 | Ji et al. | |
| 2016/0323003 | A1* | 11/2016 | Shi | H04M 1/03 |
| 2017/0289674 | A1* | 10/2017 | Shi | H04R 1/2842 |

FOREIGN PATENT DOCUMENTS

| | | | |
|---|---|---|---|
| CN | 103596102 | A | 2/2014 |
| CN | 203708470 | U | 7/2014 |
| CN | 104168528 | A | 11/2014 |

* cited by examiner

LOUDSPEAKER MODULE

CROSS-REFERENCE TO RELATED APPLICATION

This is a continuation of U.S. application Ser. No. 15/507,997, filed Mar. 1, 2017, which was the National-Stage application of International Application No. PCT/CN2015/082939, filed Jun. 30, 2015 which was published under PCT Article 21(2) and which claims priority to Chinese Application No. 201410440173.5, filed Sep. 1, 2014, all of which are incorporated herein in their entirety by reference.

TECHNICAL FIELD

This application pertains to the technical field of electroacoustic products, and particularly to a loudspeaker module with a super slim structure.

BACKGROUND

Loudspeaker modules are important acoustic component in portable electronic devices, are used to complete the conversion between an electrical signal and an acoustic signal, and serve as an energy conversion device.

The structures of the current loudspeaker module all comprise a module casing in which a loudspeaker unit is received. The loudspeaker unit is structured as shown in FIG. 8 and comprises a front cover (not shown in the figure) and a casing 11*b* which are engaged together, a vibration system and a magnetic circuit system are received in a space encompassed by the front cover and the casing 11*b*, a bottom of a frame 140*b* of the magnetic circuit system is exposed out of the casing 11*b*, and a rear sound aperture 18*b* is disposed between each of the four corners of the frame 140*b* and the casing 11*b*. The rear sound aperture is disposed at the bottom of the loudspeaker unit, so that a sufficient space for the propagation of acoustic waves is left between the bottom of the loudspeaker unit and the module casing, so the thickness of the loudspeaker module is large. However, the current portable electronic devices are constantly developing in the trend of light weight, slimness and small size. Hence, the current loudspeaker modules with large thicknesses cannot meet the requirements of the portable electronic device at all.

In addition, the loudspeaker unit is disposed in the interior of the module casing; if a voice coil of the vibration system is to achieve electrical connection with a module external circuit, a second electrical connection member needs to be disposed on the module casing; and the voice coil is electrically connected with a first electrical connection member of the loudspeaker unit itself, then the first electrical connection member is electrically connected with the second electrical connection member, and the second electrical connection member is then electrically connected with the module external circuit. In such a relay manner the electrical connection between the voice coil and the module external circuit is achieved. That manner does not only increase the costs of the loudspeaker module, but also increases the difficulty in assembling the module and reduces the production efficiency and stability of the module. In addition, other objects, desirable features and characteristics will become apparent from the subsequent summary and detailed description, and the appended claims, taken in conjunction with the accompanying drawings and this background.

SUMMARY

A technical problem to be solved by the present disclosure is to provide a loudspeaker module. The loudspeaker module exhibits a smaller thickness, can meet the requirements on slimness-oriented development of portable electronic devices, and exhibits a simple structure and a high acoustic performance of products.

To solve the above technical problem, the present disclosure employs the following technical solutions:

A loudspeaker module comprises a loudspeaker unit, the loudspeaker unit comprises a front cover and a casing which are engaged together, a vibration system and a magnetic circuit system are received in a space enclosed by the front cover and the casing, wherein the loudspeaker module further comprises an independent housing, the independent housing encloses a sealed cavity, the independent housing is provide with an opening communicating the cavity with the exterior; a sidewall of the casing is provided with a rear sound aperture radiating an acoustic wave to a side; the side of the loudspeaker unit provided with the rear sound aperture is sealingly engaged with the independent housing at the opening, a structure of the opening matches with the loudspeaker unit, and the rear sound aperture communicates with the cavity; and after the loudspeaker unit is engaged with the independent housing, the cavity forms a rear acoustic cavity of the loudspeaker module.

Optionally, the loudspeaker unit is a rectangular structure, the rear sound aperture is disposed on a side of the casing, the side of the loudspeaker unit provided with the rear sound aperture is inserted in the opening, and the opening is shaped and sized to match with the inserted portion of the loudspeaker unit.

Optionally, the casing on the side provided with the rear sound aperture is provided with a first stepped structure, a lower edge of the opening of the independent housing is snap-fitted underside the first stepped structure, and a lower surface of the independent housing flushes with a lower end face of the casing.

Optionally, the front cover located on the same side as the rear sound aperture is provided with a second stepped structure, and an upper edge of the opening of the independent housing is snap-fitted on an upper side of the second stepped structure.

Optionally, the independent housing is provided with a third stepped structure cooperating with the second stepped structure, the third stepped structure is snap-fitted on an upper side of the second stepped structure, and an upper surface of the independent housing flushes with an upper end face of the front cover.

Optionally, the first stepped structure comprises a first sidewall located in the rear acoustic cavity and engaged with the front cover, the first sidewall is perpendicularly connected with a stepped face, the stepped face is perpendicularly connected with a second sidewall, the second sidewall is perpendicularly connected with a lower end face of the casing, and an open end of the rear sound aperture is disposed through the first sidewall, the stepped face and the second sidewall.

Optionally, a connection elastic tab for electrically connecting the vibration system with the module external circuit is respectively disposed at edge portions of two opposed sides of the casing, and parts of the connection elastic tabs electrically connected with the module external circuit protrude out of the lower end face of the casing.

Optionally, the two connection elastic tabs are disposed on two long sides of the casing, and the rear sound aperture is disposed on one short side of the casing.

Optionally, the two connection elastic tabs are respectively disposed at the same ends of said two long sides and the two connection elastic tabs are both disposed away from the rear sound aperture.

Optionally, the loudspeaker unit is engaged with the independent housing by ultrasonic welding or applying an adhesive for sealing.

The following advantageous effects are achieved by the present disclosure after the above technical solutions are employed:

The loudspeaker module according to an embodiment of the present disclosure comprises a loudspeaker unit, and the sidewall of the casing of the loudspeaker unit is provided with a rear sound aperture radiating an acoustic wave to a side; the module further comprises an independent housing enclosing a sealed cavity, the independent housing is provide with an opening communicating the cavity with the exterior, the side of the loudspeaker unit provided with the rear sound aperture is sealingly engaged with the opening, and the rear sound aperture communicates with the cavity; after the loudspeaker unit is engaged with the independent housing, the cavity of the independent housing forms a rear acoustic cavity of the module. The rear sound aperture of the loudspeaker unit is disposed on a side and engages from the side the independent housing which encloses the rear acoustic cavity, so that air stream exchange is performed from the side between the interior of the loudspeaker unit and the rear acoustic cavity. As compared with the prior art wherein the rear sound aperture is disposed at the bottom of the loudspeaker unit, the loudspeaker unit of the present disclosure is not required to be completely disposed in the casing of the module, and an air stream circulation space is not required to be provided between the bottom of the loudspeaker unit and the casing of the module, so that the present disclosure greatly reduces the thickness of the module and meets the requirements on slimness-oriented development of portable electronic devices. Furthermore, the rear sound aperture is disposed on the side, the air stream is not blocked by the casing of the module, and the air stream circulation with the rear acoustic cavity is smoother, thereby effectively improving the acoustic performance of the loudspeaker module. In addition, in the present disclosure, a casing for receiving the loudspeaker unit is not needed, and only the independent housing enclosing the rear acoustic cavity is required to form the loudspeaker module, thereby substantially simplifying the structure of the module, simplifying the assembling steps of the module, and improving the production efficiency of the module.

A connection elastic tab for electrically connecting the vibration system with the module external circuit is respectively disposed at edge portions of two opposed sides of the casing, and parts of the connection elastic tabs electrically connected with the module external circuit protrude out of the lower end face of the casing. The vibration system and the module external circuit of the present disclosure may achieve electrical connection by using only the connection elastic tabs, and the present disclosure is not required to use two types of different electrical connection members to achieve the electrical connection, and one electrical connection member is omitted, thereby reducing the production costs of the product, simplifying the assembling steps of the module and improving the production efficiency of the module. Since one assembling step is omitted, the stability of the loudspeaker module is greatly improved and product quality is enhanced.

In another embodiment, a loudspeaker module includes, but is not limited to an independent housing. The independent housing encloses a sealed cavity, and the independent housing is provided with an opening communicating the cavity with the exterior. The loudspeaker module further includes, but is not limited to, a loudspeaker unit. The loudspeaker unit includes, but is not limited to a vibration system, a magnetic circuit system and a casing and a front cover that receive the vibration system and the magnetic circuit system. A sidewall of the casing is provided with a rear sound aperture. An acoustic wave above the vibration system directly radiates to the exterior, and an acoustic wave below the vibration system radiates to a side via the rear sound aperture. The loudspeaker unit and the independent housing combine, so that the rear sound aperture and the opening are sealingly engaged and communicate, and the cavity of the independent housing forms a rear acoustic cavity of the loudspeaker module.

To conclude, the present disclosure solves the technical problems in the prior art such as large loudspeaker module thickness and complicated structure, and the loudspeaker module according to the present disclosure exhibits a small thickness, simple structure, high acoustic performance, low production costs and high production efficiency.

The above depictions are only generalization of the technical solutions of the present disclosure, which may be implemented according to the contents of the description to make the technical means of the present disclosure clearer. Specific embodiments of the present disclosure are presented below to make the above and other objects, features and advantages of the present disclosure more apparent.

BRIEF DESCRIPTION OF DRAWINGS

The present invention will hereinafter be described in conjunction with the following drawing figures, wherein like numerals denote like elements, and.

In the figures, the reference number 10 denotes loudspeaker unit, 11*a* casing, 11*b* casing, 110 first sidewall, 112 stepped face, 114 second sidewall, 12 front cover, 120 second stepped structure, 122 front sound aperture, 130 vibrating diaphragm, 132 dome, 134 cushion ring, 136 voice coil, 140*a* frame, 140*b* frame, 142 magnet, 144 washer, 16 connection elastic tab, 18*a* rear sound aperture, 18*b* rear sound aperture, 20 independent housing, 22 opening, and 220 third stepped structure.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The present disclosure is further illustrated in conjunction with the figures and the embodiments.

The orientation "up" involved in the present description refers to the direction of the vibration system of the loudspeaker unit, and the orientation "down" refers to the direction of the magnetic circuit system of the loudspeaker unit. "Inside" involved in the present description refers to the side located in the module inner cavity, and "outside" refers to the side located out of the module inner cavity.

Figure 1:
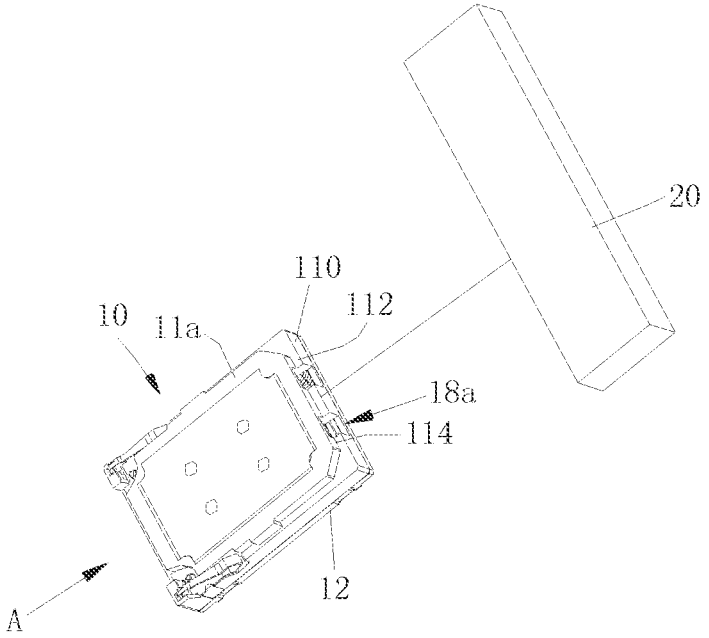
FIG. 1 is a 3-dimensional exploded structural schematic view of a loudspeaker module according to the present disclosure.
Figure 2:
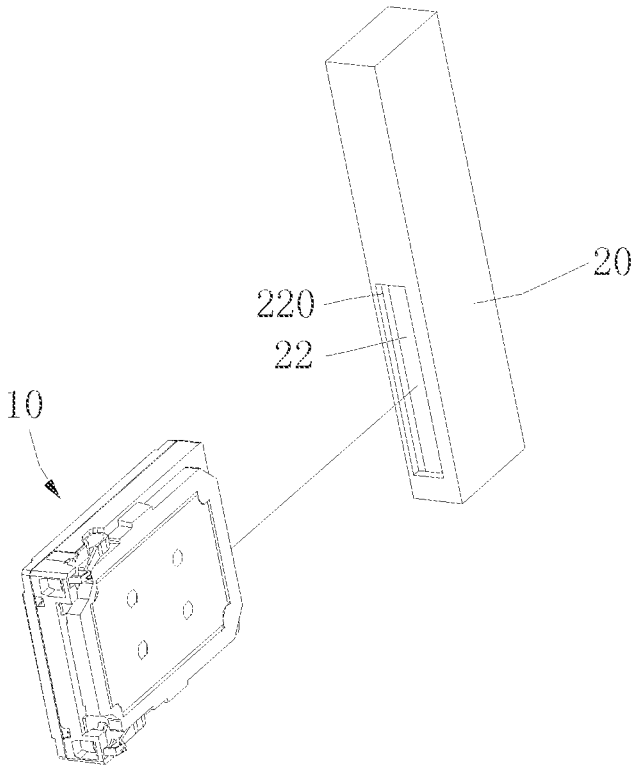
FIG. 2 is a view as viewed in the direction A of FIG. 1.
Figure 3:
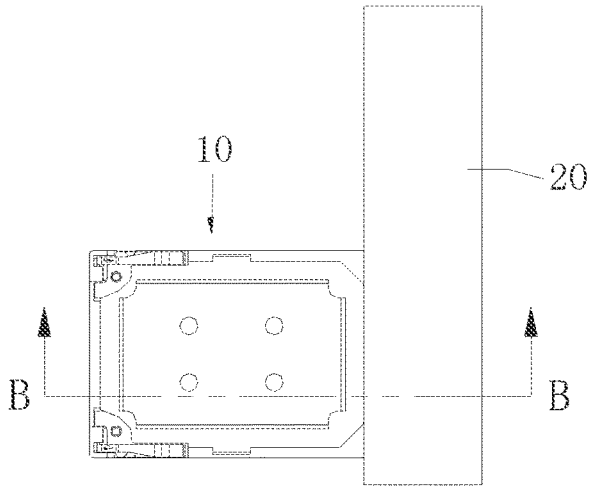
FIG. 3 is a combination view of FIG. 1.
Figure 4:
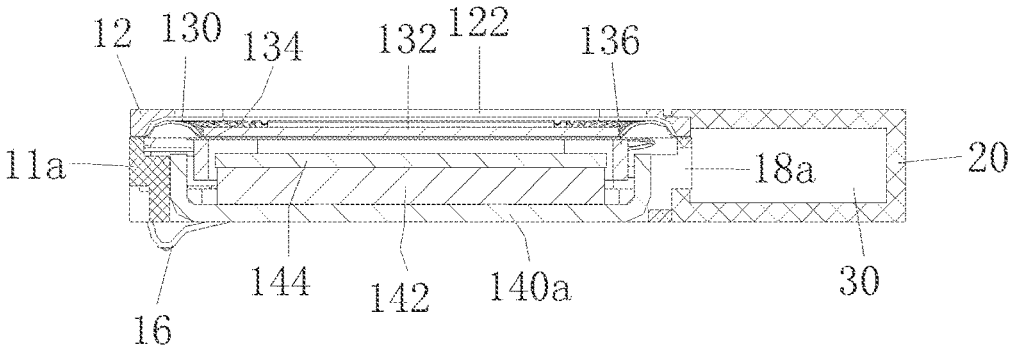
FIG. 4 is an enlarged sectional view taken along the line B-B of FIG. 3.

As jointly shown in FIG. 1, FIG. 2 and FIG. 3, a loudspeaker module comprises a loudspeaker unit 10, the loudspeaker unit 10 comprises a front cover 12 and a casing 11*a* which are engaged together, a vibration system and a magnetic circuit system are received in a space enclosed by the front cover 12 and the casing 11*a*, and the loudspeaker unit 10 is a rectangular structure. A sidewall of the casing 11*a* is provided with a rear sound aperture 18*a* radiating acoustic waves to the side, there are totally two rear sound apertures 18*a*, and the two rear sound apertures 18*a* are both disposed on the same side of the casing 11*a*. The module further comprises an independent housing 20, the independent housing 20 is a cuboid structure and it encloses a sealed cavity, a sidewall of the independent housing 20 is provided with an opening 22, the opening 22 is rectangular and is sized to match with the side of the loudspeaker unit 10 provided with the rear sound aperture 18*a*, the loudspeaker unit 10 on the side provided with the rear sound aperture 18*a* is sealingly engaged with the opening 22, the rear sound aperture 18*a* communicates with the cavity enclosed by the independent housing 20, and the cavity of the independent housing 20 forms a rear acoustic cavity 30 (as shown in FIG. 4) of the module after the loudspeaker unit 10 is engaged with the independent housing 20. The rear sound aperture 18*a* is disposed on a side of the loudspeaker unit 10, and engaged from the side the independent housing 20 which encloses the rear acoustic cavity 30, so that air stream exchange is performed from the side between the interior of the loudspeaker unit and the rear acoustic cavity, without disposing the loudspeaker unit 10 completely in the cavity of the module, thereby substantially reducing the thickness of the module. Furthermore, the rear sound aperture 18*a* is disposed on the side, so that air stream circulates more smoothly, and the acoustic performance of the module is effectively improved.

As jointly shown in FIG. 1, FIG. 4, FIG. 5 and FIG. 6, the casing 11*a* on the side provided with the rear sound aperture 18*a* is provided with a first stepped structure, the first stepped structure comprises a first sidewall 110 located in the rear acoustic cavity 30 and engaged with the front cover 12, the first sidewall 110 is perpendicularly connected with a stepped face 112, the stepped face 112 is perpendicularly connected with a second sidewall 114, the second sidewall is perpendicularly connected with a lower end face of the casing 11*a*, open ends of the two rear sound apertures 18*a* are both disposed through the first sidewall 110, the stepped face 112 and the second sidewall 114. Such a design of the rear sound apertures 18*a* allows for a larger size of the rear sound apertures, and only two rear sound apertures are needed to meet the requirements on the acoustic performance of the module, and meanwhile such a structure of the rear sound apertures 18*a* simplifies the structure of the casing 11*a* and makes the processing of the casing 11*a* simpler. When the loudspeaker unit 10 is engaged with the independent housing 20, the independent housing 20 located at a lower edge position of the opening 22 (as shown in FIG. 2) is snap-fitted between the stepped face 112 and the second sidewall 114, that is, the independent housing 20 is located underside the stepped face 112, and a lower surface of the independent housing 20 flushes with a lower end face of the casing 11*a*. Designing the casing 11*a* as the stepped structure not only increases the contact area between the casing 11*a* and the independent housing 20 to enable more tight sealing between the two, but also effectively uses the internal space of the loudspeaker unit 10 and minimizes the thickness of the module.

Figure 7:
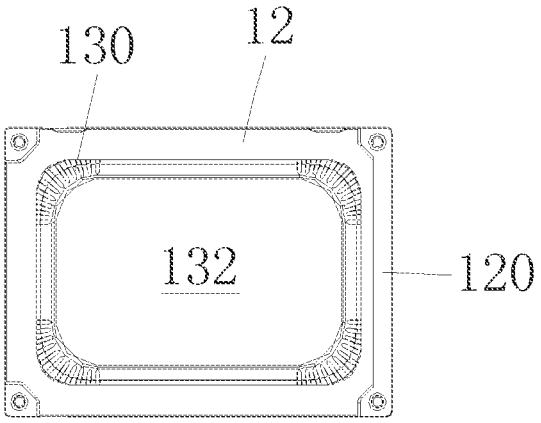
FIG. 7 is a rear view of FIG. 5.
Figure 8:
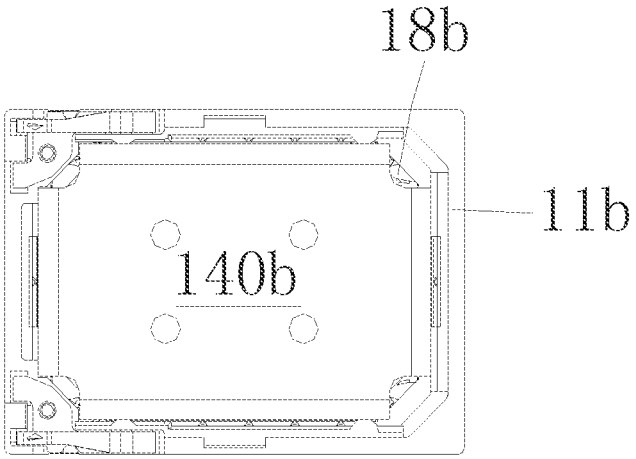
FIG. 8 is a structural schematic view of a loudspeaker unit in the prior art.

As jointly shown in FIG. 2, FIG. 4 and FIG. 7, the front cover 12 located on the same side as the rear sound aperture 18*a* is provided with a second stepped structure 120, the second stepped structure 120 is like the first stepped structure and also includes two sidewalls and one stepped face. The independent housing 20 at the upper edge of the opening 22 is provided with a third stepped structure 220 mating with the second stepped structure 120, the third stepped structure 220 and the second stepped structure 120 have the same structure but opposite directions. When the loudspeaker unit 10 is engaged with the independent housing 20, the third stepped structure 220 is snap-fitted on the upper side of the second stepped structure 120, and the upper surface of the independent housing 20 flushes with the end face of the front cover 12. The designs of the second stepped structure 120 and the third stepped structure 220 not only increase the contact area between the front cover 12 and the independent housing 20 to enable more tight sealing between the two, but also effectively use the thickness of the front cover 12 and the thickness of the upper wall of the independent housing 20 and further reduce the thickness of the module, so that the loudspeaker module can meet the requirements on slimness-oriented development of portable electronic devices.

As jointly shown in FIG. 3 and FIG. 4, the loudspeaker unit 10 is engaged with the independent housing 20 by ultrasonic welding or applying an adhesive for sealing.

As shown in FIG. 4, the vibration system comprises a vibrating diaphragm 130 whose edge portion is fixed between the casing 11*a* and the front cover 12, a dome 132 is fixed at an intermediate position of the side of the vibrating diaphragm 130 adjacent to the front cover 12, a cushion ring 134 is fixed on the other side of the vibrating diaphragm, and a voice coil 136 is fixed on the cushion ring 134. The cushion ring 134 is used to enhance the mechanical strength of the vibrating diaphragm 130 and increases the engagement firmness between the vibrating diaphragm 130 and the dome 132 and the voice coil 136. The magnetic circuit system comprises a frame 140*a* fixed on the casing 11*a*, the frame 140*a* comprises a rectangular bottom and sidewalls disposed around the bottom and perpendicular to the bottom, the middle portion inside the frame 140*a* is fixed with a magnet 142 and a washer 144 in sequence, a magnetic gap is provided between on one hand the magnet 142 and the washer 144 and on the other hand the frame sidewalls, and an end of the voice coil 136 is located in the magnetic gap. The voice coil 136 makes up-down movement in the magnetic gap according to the magnitude and the direction of an acoustic electrical signal passing through its winding, and the vibrating diaphragm 130 vibrates along with the up-down movement of the voice coil 136, urges air to generate a sound and thereby completes the electro-acoustic energy conversion. A front sound aperture 122 is provided on the front cover 12 at a location corresponding to the vibrating diaphragm. The acoustic wave radiates from the front sound aperture 122 to the exterior of the module.

Figure 5:
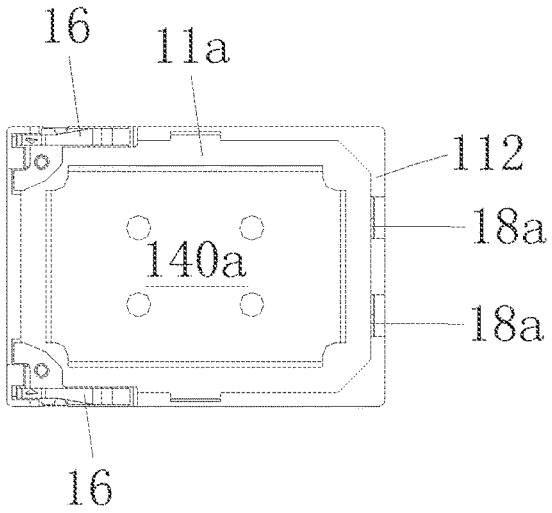
FIG. 5 is a structural schematic view of the loudspeaker unit in FIG. 1.
Figure 6:
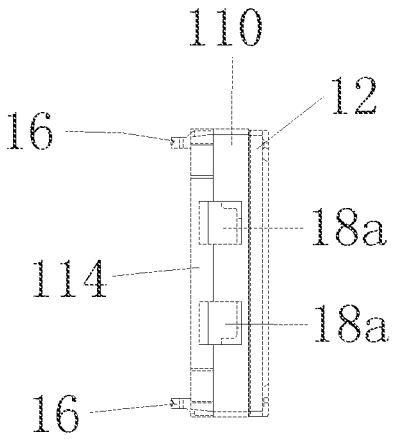
FIG. 6 is a right view of FIG. 5.

As jointly shown in FIG. 4 and FIG. 5, the lower end face of the casing 11*a* is provided with a mounting hole sized and shaped to be consistent with the bottom of the frame 140*a*, the bottom of the frame 140*a* is located in the mounting hole and the external surface of the bottom of the frame 140*a* flushes with the lower end face of the casing 11*a*, and the bottom of the frame 140*a* is sealingly engaged with the casing 11*a*. The design of the mounting hole effectively uses the thickness of the lower end face of the casing 11*a*, effectively reduces the thickness of the loudspeaker unit and meanwhile reduces the thickness of the module.

As jointly shown in FIG. 4 and FIG. 5, a connection elastic tab 16 for electrically connecting the voice coil 136 with the module external circuit is respectively disposed at edge positions of two opposed long sides of the casing 11*a*, and parts of the two connection elastic tabs 16 electrically connected with the module external circuit protrude out of the lower end face of the casing 11*a*. The connection elastic tabs 16 can directly implement the electrical connection of the voice coil 136 and the module external circuit, and omit one electrical connection member as compared with the prior art, which does not only reduce the production costs of the module and simplify the assembling steps of the module, but also improves the stability of the module and enhances product quality.

As shown in FIG. 5, the rear sound apertures 18*a* are disposed on a short side of the loudspeaker unit 10, and the two connection elastic tabs 16 are both disposed away from the rear sound apertures 18*a*. Such an arrangement manner of the rear sound apertures 18*a* and the connection elastic tabs 16 is a preferred manner of the present embodiment. In practical application, the rear sound apertures may be disposed on any sidewall of the casing, including the same side of the casing as the connection elastic tabs. Those skilled in the art, according to the above depictions of the description and without the exercise of any inventive skills, can fabricate products with the rear sound apertures being disposed on the other sidewalls of the casing, so specific embodiments that the rear sound apertures are disposed on the other sidewalls of the casing are not detailed any more here.

The technical solution of the present disclosure that the rear sound apertures of the loudspeaker unit are disposed on the side and the loudspeaker unit is exposed out of the module and engaged with the independent housing enclosing the rear acoustic cavity of the module is not limited to the structure described by the above embodiments. The structure of the loudspeaker module described in the above embodiments is only an exemplary illustration given by the inventor to expound on the present technical solution. In practical application, the structure of the loudspeaker unit and the structure of the independent housing may employ other structures such as a round, a track-shaped or an oval loudspeaker unit. The independent housing may be shaped and structured according to the structure of the loudspeaker unit and the internal space of the portable electronic device, to achieve the same technical effect as that of the present disclosure. Therefore, no matter whether the structures of the loudspeaker unit and the independent housing are the same as the above depictions of the description, a loudspeaker module product falls within the protection scope of the present disclosure so long as the loudspeaker module is a loudspeaker module product in which the rear sound apertures of the loudspeaker unit are disposed on the side and the loudspeaker unit is exposed out of the module and is only engaged with an independent housing.

The naming of the first stepped structure, the second stepped structure and the third stepped structure involved in the present disclosure is only intended to distinguish the technical features, and does not represent the installation order, the operation order or the positional relationship of the three stepped structures.

The naming of the first sidewall and second sidewall involved in the present disclosure is only intended to distinguish the technical features, and does not represent the installation order, the operation order or the positional relationship of the two sidewalls.

The present disclosure is not limited to the above embodiments. Diverse variations envisaged by those skilled in the art from the above idea without paying creative work all fall within the protection scope of the present disclosure.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A loudspeaker module, comprising:

an independent housing, the independent housing encloses a sealed cavity, and the independent housing is provided with an opening communicating the cavity with an exterior of the independent housing;

a loudspeaker unit, the loudspeaker unit comprises a vibration system, a magnetic circuit system and a casing and a front cover that receive the vibration system and the magnetic circuit system, a sidewall of the casing is provided with a rear sound aperture, acoustic wave generated by the loudspeaker unit above the vibration system directly radiates to the exterior, and acoustic wave generated by the loudspeaker unit below the vibration system radiates to a side via the rear sound aperture; and the loudspeaker unit and the independent housing combine, so that the rear sound aperture and the opening are sealingly engaged and communicate, and the cavity of the independent housing forms a rear acoustic cavity of the loudspeaker module; wherein a height of the independent housing and a height of the loudspeaker unit are equal, and an upper surface and a lower surface of the independent housing are respectively flush with an upper surface and a lower surface of the loudspeaker unit.

2. The loudspeaker module according to claim 1, wherein, the opening is provided on a side of the independent housing, and the independent housing is located on a side of the loudspeaker unit.

3. The loudspeaker module according to claim 2, wherein, the side of the loudspeaker unit that is provided with the rear sound aperture is inserted into the opening of the independent housing, and is sealingly engaged at a socketing position.

4. The loudspeaker module according to claim 3, wherein, the casing is provided with a first stepped structure on the side that is provided with the rear sound aperture, and a lower edge of the opening of the independent housing is snap-fitted on a lower side of the first stepped structure.

5. The loudspeaker module according to claim 4, wherein, the front cover is provided with a second stepped structure located on the side the same as the rear sound aperture, and an upper edge of the opening of the independent housing is snap-fitted on an upper side of the second stepped structure.

6. The loudspeaker module according to claim 5, wherein, the independent housing is provided with a third stepped structure that cooperates with the second stepped structure, and the third stepped structure is snap-fitted on an upper side of the second stepped structure.

7. The loudspeaker module according to claim 3, wherein, the socketing positions of the loudspeaker unit and the independent housing are sealingly engaged by ultrasonic welding or applying an adhesive.

8. The loudspeaker module according to claim 4, wherein, the first stepped structure comprises a first sidewall located in the rear acoustic cavity and engaged with the front cover, the first sidewall is perpendicularly connected with a stepped face, the stepped face is perpendicularly connected with a second sidewall, the second sidewall is perpendicularly connected with a lower end face of the casing, and an open end of the rear sound aperture is disposed through the first sidewall, the stepped face and the second sidewall.

9. The loudspeaker module according to claim 1, wherein the casing is provided with two rear sound apertures on the same sidewall, the independent housing is provided with one opening, and both of the two rear sound apertures communicate with the one opening.

10. The loudspeaker module according to claim 1, wherein, a connection elastic tab for electrically connecting the vibration system with a loudspeaker module external circuit is respectively disposed at edge portions of two opposed sides of the casing, and the parts of the connection elastic tabs that are electrically connected with the loudspeaker module external circuit protrude out of the lower end face of the casing.

11. The loudspeaker module according to claim 10, wherein, the two connection elastic tabs are both disposed away from the rear sound aperture.

12. The loudspeaker module according to claim 10, wherein, the loudspeaker unit is of a rectangular structure, the two connection elastic tabs are disposed on two long sides of the casing, and the rear sound aperture is disposed on one short side of the casing.

13. The loudspeaker module according to claim 12, wherein, the two connection elastic tabs are respectively disposed at the same ends of said two long sides, and the two connection elastic tabs are both disposed away from the rear sound aperture.

14. The loudspeaker module according to claim 1, wherein, the magnetic circuit system comprises a frame, a lower end face of the casing is provided with a mounting hole that is sized and shaped to be consistent with those of a bottom of the frame, the bottom of the frame is located in the mounting hole and an external surface of the bottom of the frame flushes with the lower end face of the casing, and the bottom of the frame is sealingly engaged with the casing.

* * * * *